US006158922A

United States Patent [19]

Fernandez

[11] Patent Number: 6,158,922

[45] Date of Patent: Dec. 12, 2000

[54] SAND TRAP FOR EROSION CONTROL

[76] Inventor: Jorge L. Fernandez, 1065 W. 46 St., Miami Beach, Fla. 33140

[21] Appl. No.: 09/263,285

[22] Filed: Mar. 5, 1999

[51] Int. Cl.[7] ..... E02B 3/04

[52] U.S. Cl. ..... 405/21; 405/15

[58] Field of Search ..... 405/15, 16, 19, 405/20, 21, 73; 404/40–42

[56] References Cited

U.S. PATENT DOCUMENTS

| | | | |
|---|---|---|---|
| 953,051 | 3/1910 | Muralt | 405/16 |
| 3,597,928 | 8/1971 | Pilaar | 405/16 |
| 4,172,680 | 10/1979 | Brown | 405/16 |
| 4,896,996 | 1/1990 | Mouton et al. | 405/21 |

FOREIGN PATENT DOCUMENTS

| | | |
|---|---|---|
| 0315731 | 12/1988 | Japan . |
| 134550 | 12/1950 | Netherlands . |
| 877712 | 9/1961 | United Kingdom . |

*Primary Examiner*—Eileen D. Lillis
*Assistant Examiner*—Sunil Singh
*Attorney, Agent, or Firm*—J. Sanchelima

[57] ABSTRACT

A system for combating coastal erosion comprised of a sufficient number of sand trapping assemblies that include a conical member and a hexagonal base. The conical member has upper and lower ends with respective openings for receiving and discharging the sand brought by the water currents. Contiguous assemblies are disposed so that the entire bottom surface is covered. The hexagonal base interlocks the different assemblies. If necessary, one way stakes can be used to further secure the assemblies to the bottom of the body of water being protected.

2 Claims, 2 Drawing Sheets

SAND TRAP FOR EROSION CONTROL

BACKGROUND OF THE INVENTION

1. Field of the Invention

The present invention relates to a system for controlling seashore erosion, and more particularly, to system that includes interlocking assemblies that cover completely the bottom of the body of water.

2. Description of the Related Art

Erosion on the seashore is responsible for important changes in our environment. It impacts the ecological equilibrium of our beaches directly, and indirectly, the animals that inhabit it. Attempts to combat the slow, but sure, process of erosion are well documented. One of these attempts is disclosed in U.S. Pat. No. 4,896,996 issued to Mouton et al. in 1990 for a Wave Actuated Coastal Erosion Reversal System for Shorelines. The patented system uses beach cones that extend over a predetermined area. The dimensions of the beach cones are such that four contiguous beach cones form a cruciform cavity 20. The patentees also provide for the usage of anchorage accessories, as it will more than likely be required in areas when the currents are strong. Additional beach cones can be stacked up to any desirable height.

The present invention differs in several respects even though the basic assembly also utilizes a cone with upper and lower openings to trap and deposit the sand carried by the currents. But, the present invention also includes an hexagonal base as an extension of the peripheral edge of the beach cones. This permits the total covering of the bottom and an interlocking arrangement that prevents the lifting of the assemblies.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a system for trapping and depositing sand in a predetermined area with basic interlocking assemblies without requiring special tools.

It is another object of this invention to provide a system that is susceptible to being mass produced with uniform and standard basic assemblies that are volumetrically efficient when stored and/or transported.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
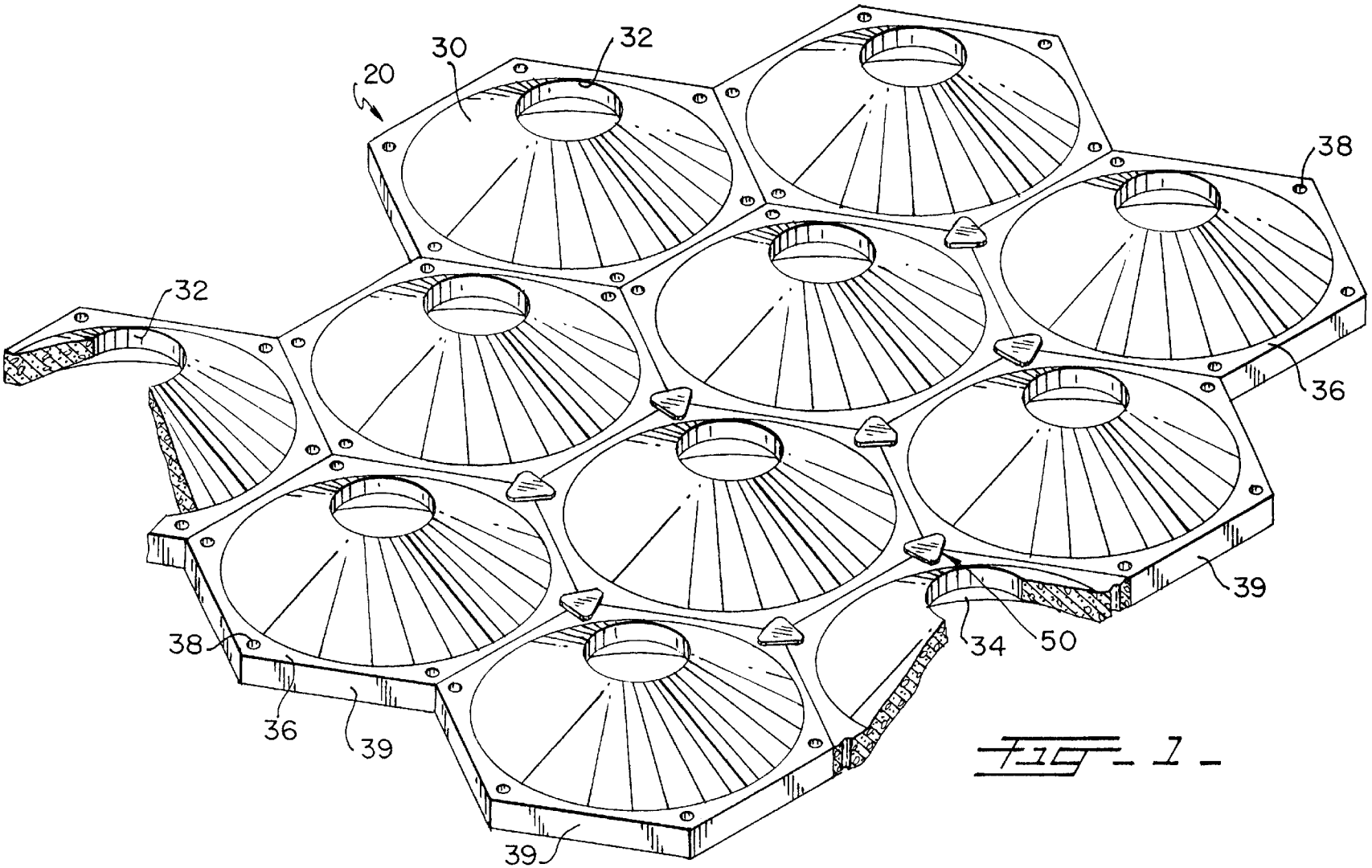
FIG. 1 is an isometric view of a group of several basic assemblies.

Referring now to the drawings, where the present invention includes a basic sand trapping assembly 20 with cone 30 that has upper opening 32 and larger lower opening 34. Hexagonal base 36 provides the support for basic sand trapping assembly 20. Base 36 is provided with through openings 38 for cooperatively receiving anchorage elements, if necessary, to further ensure the immobilization of assemblies 20. Anchorage elements, in the preferred embodiments, are implemented with one way stake members 50 that include arrow heads 52 capable of being buried in the sand, as shown in FIG. 2.

Figure 3:
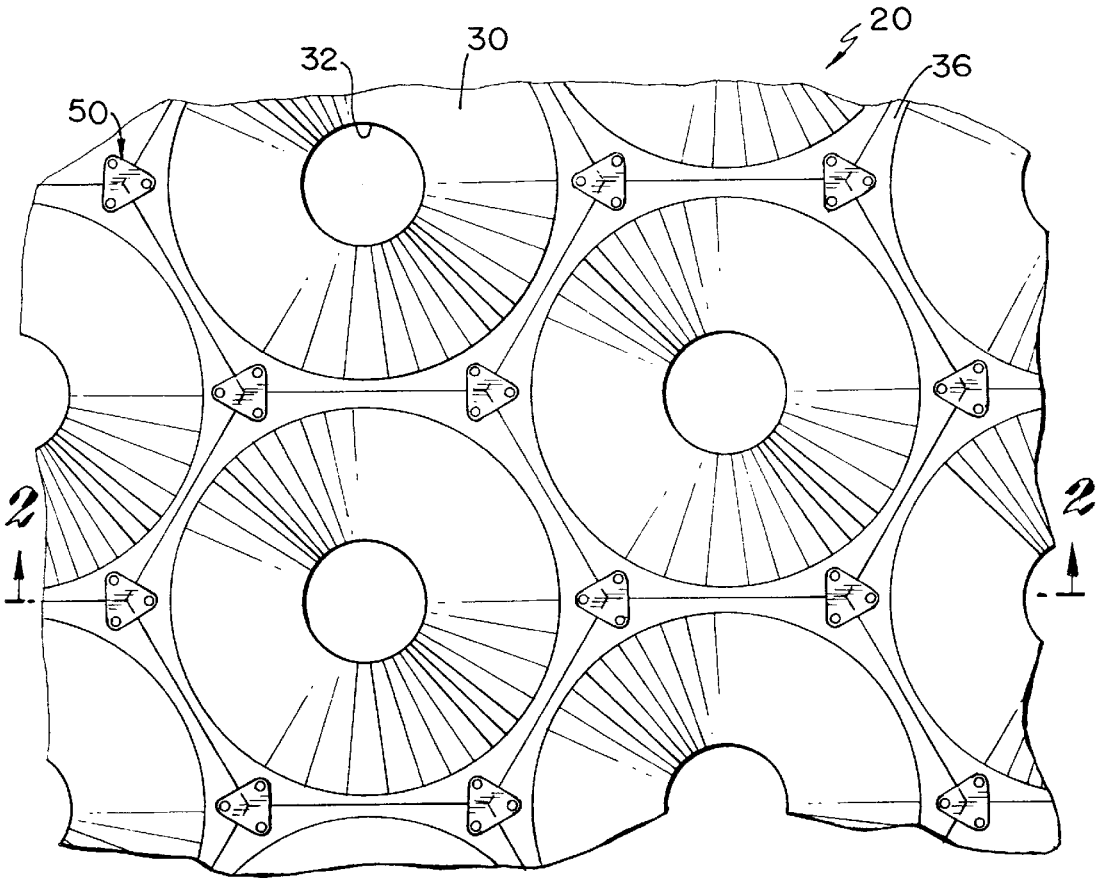
FIG. 3 illustrates a top view of a group of basic assemblies.

Assemblies 20 are preferably made out of concrete but other materials, such as plastic, can also be used. In laying assemblies 20, a user brings each side 39 of assemblies 20 in abutting contact with other sides 39 of other assemblies 20. The hexagonal shape cooperates to fully cover the area being treated and, in most instances, additional anchorage elements are not needed. This is one of the important differences with the prior art. The interlocking action inherent in the hexagonal shape permits a user to fully cover a predetermined area, as best seen in FIG. 3.

The water movements in a body of water, including currents, waves, turbulences, etc., cause sands and other particles to be trapped within assemblies 20 when they fall through opening 32. Once inside assembly 20, it is very difficult for sand S to escape out and it tends to accumulate thereby rebuilding the areas where erosion has taken away the sand.

Figure 2:
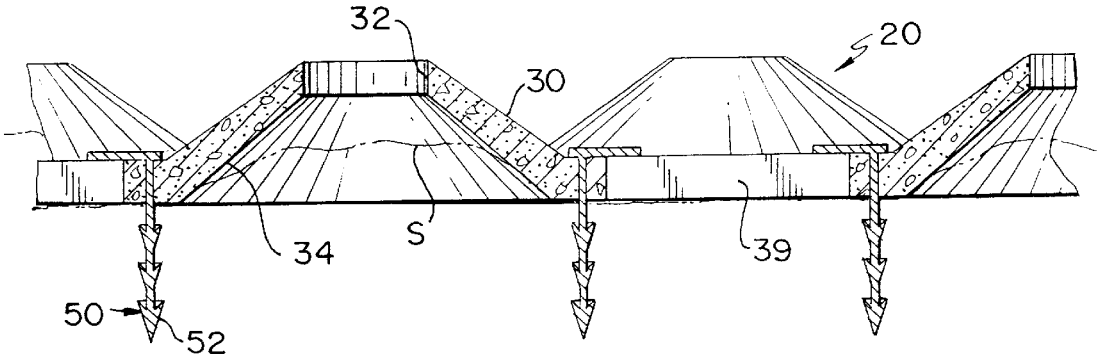
FIG. 2 is an elevational cross-section of a basic assembly and part of another one, which are connected to a third one in the back.

The angle of the peripheral wall of cone 30 ranges from 20 to 60 degrees, and one of the preferred embodiments, 45 degrees has been shown in FIG. 2.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for fighting coastal erosion, comprising a plurality of sand trapping assemblies each including a conical member with upper and lower ends, said lower end having a peripheral edge defining a lower opening and a hexagonal base extending outwardly from said peripheral edge said upper end having an upper opening with a diameter smaller than the diameter of said lower opening, said plurality of sand trapping assemblies being abuttingly disposed with each sand trapping assembly being in contact with six other sand trapping assemblies so that a surface being protected is completely covered, and further including anchorage means for keeping said sand trapping assemblies secured to said surface being protected the hexagonal base includes a plurality of through openings that cooperate with said anchorage means.

2. The system set forth in claim 1 wherein said anchorage means includes a plurality of one way stakes that are cooperatively inserted through said through openings to further secure said assemblies together.

* * * * *